US011400340B2

(12) United States Patent
Seidler

(10) Patent No.: US 11,400,340 B2
(45) Date of Patent: Aug. 2, 2022

(54) DEVICE FOR A PERSON TO SIT ON FOR TRAINING PURPOSES FOR EXECUTING A LEG ROTATION MOVEMENT SIMILAR TO RIDING A BICYCLE

(71) Applicant: Mathias Seidler, Hamburg (DE)

(72) Inventor: Mathias Seidler, Hamburg (DE)

( * ) Notice: Subject to any disclaimer, the term of this patent is extended or adjusted under 35 U.S.C. 154(b) by 29 days.

(21) Appl. No.: 16/913,480

(22) Filed: Jun. 26, 2020

(65) Prior Publication Data

US 2020/0406090 A1 Dec. 31, 2020

(30) Foreign Application Priority Data

Jun. 26, 2019 (DE) ..... 202019103536.6

(51) Int. Cl.

| | |
|---|---|
| ***A63B 22/06*** | (2006.01) |
| ***A63B 21/00*** | (2006.01) |
| ***A63B 24/00*** | (2006.01) |
| ***A63B 69/16*** | (2006.01) |

(52) U.S. Cl.

CPC .... *A63B 22/0605* (2013.01); *A63B 21/00069* (2013.01); *A63B 21/151* (2013.01); *A63B 21/4035* (2015.10); *A63B 24/0087* (2013.01); *A63B 69/16* (2013.01); *A63B 2069/162* (2013.01); *A63B 2069/165* (2013.01); *A63B 2208/0228* (2013.01); *A63B 2209/00* (2013.01); *A63B 2209/02* (2013.01)

(58) Field of Classification Search

CPC ..... A63B 21/00069; A63B 21/151; A63B 21/4035; A63B 22/0605; A63B 24/0087; A63B 69/16; A63B 2208/0228; A63B 2209/00; A63B 2209/02; A63B 2069/161; A63B 2069/162; A63B 2069/163; A63B 2069/164; A63B 2069/165; A63B 2069/166

See application file for complete search history.

(56) References Cited

U.S. PATENT DOCUMENTS

| | | | | |
|---|---|---|---|---|
| 4,441,705 A * | 4/1984 | Brown | A63B 24/00 | 482/59 |
| 4,826,150 A * | 5/1989 | Minoura | A63B 21/0051 | 310/103 |
| 4,898,379 A * | 2/1990 | Shiba | A63B 69/16 | 482/61 |
| 5,042,795 A * | 8/1991 | Bursik | A63B 69/16 | 482/61 |
| 6,712,737 B1 * | 3/2004 | Nusbaum | A63B 69/16 | 482/57 |
| 6,945,917 B1 * | 9/2005 | Baatz | A63B 21/0051 | 482/57 |
| 7,188,852 B1 * | 3/2007 | Fritschen | B62K 3/10 | 280/281.1 |

(Continued)

FOREIGN PATENT DOCUMENTS

EP 1364681 A1 11/2003

*Primary Examiner* — Joshua Lee

(74) *Attorney, Agent, or Firm* — Muncy, Geissler, Olds & Lowe, P.C.

(57) ABSTRACT

With a device for a person to sit on for training purposes for executing a leg rotation movement similar to cycling, with a saddle and a bottom bracket bearing, it is provided that it comprises at least one mounting element for immobile mounting and that it has connecting sections similar to dropouts for connection to a roller trainer.

8 Claims, 1 Drawing Sheet

(56) References Cited

U.S. PATENT DOCUMENTS

| | | | | |
|---|---|---|---|---|
| 8,033,830 | B2 * | 10/2011 | Ichimi | G09B 9/058 434/29 |
| 9,381,396 | B2 * | 7/2016 | Colan | A63B 21/0051 |
| 9,486,667 | B2 * | 11/2016 | Kimura | A63B 22/0605 |
| 10,166,434 | B2 * | 1/2019 | Caccia | A63B 22/0605 |
| 10,933,291 | B2 * | 3/2021 | Papadopoulos | A63B 69/16 |
| 2005/0209064 | A1 * | 9/2005 | Peterson | A63B 69/16 482/61 |
| 2006/0234840 | A1 * | 10/2006 | Watson | A63B 22/0605 482/61 |
| 2008/0096725 | A1 * | 4/2008 | Keiser | A63B 22/0605 482/8 |
| 2009/0152042 | A1 * | 6/2009 | Pierick | B62K 19/06 180/311 |
| 2012/0322621 | A1 * | 12/2012 | Bingham, Jr. | A63B 21/0088 482/8 |
| 2015/0011364 | A1 | 1/2015 | Kimura | |
| 2015/0080191 | A1 | 3/2015 | Irving et al. | |
| 2015/0217158 | A1 * | 8/2015 | Colan | A63B 21/0051 482/61 |
| 2018/0369675 | A1 * | 12/2018 | Papadopoulos | A63B 69/16 |

* cited by examiner

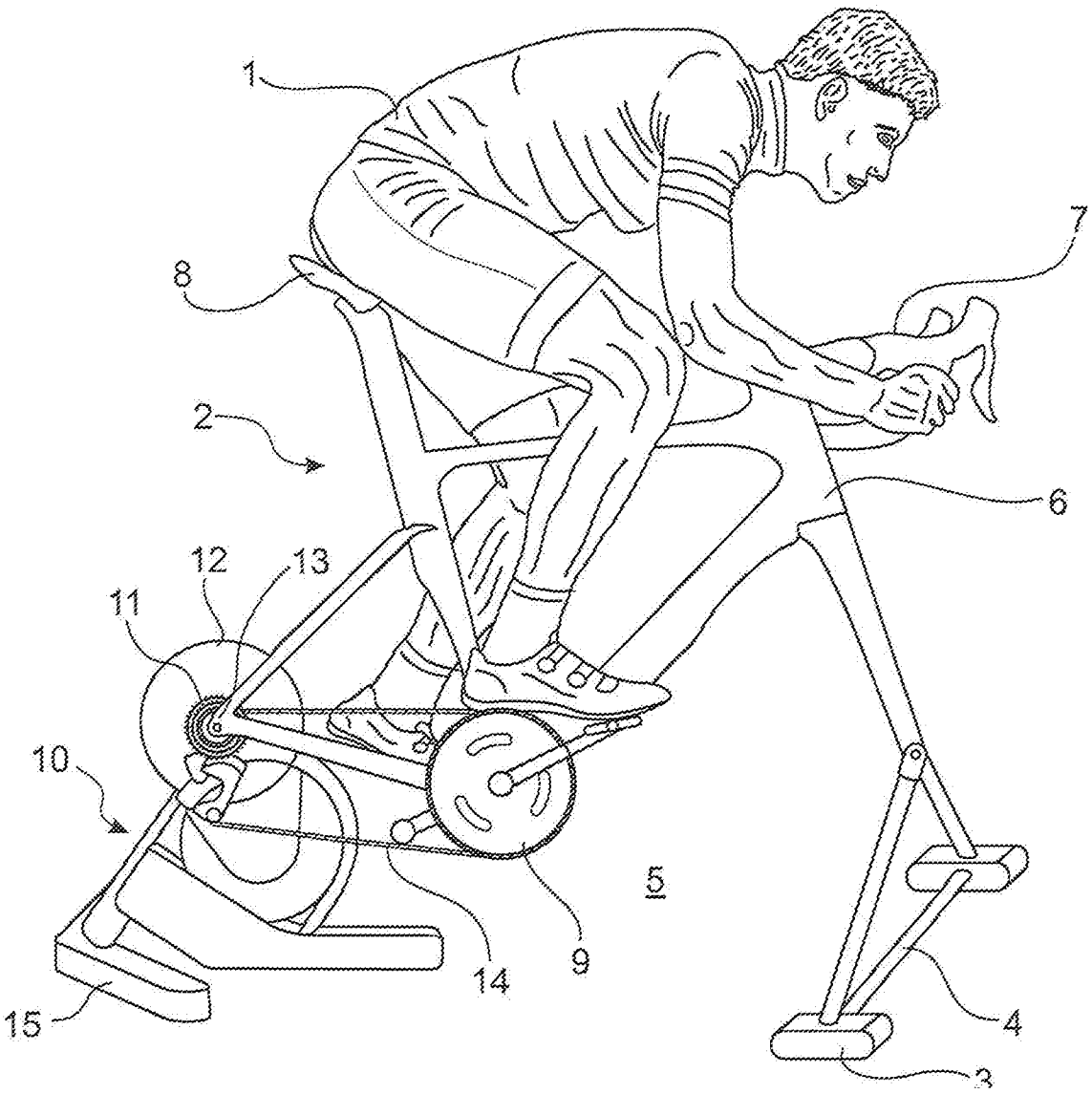
1
2
3
4
5
6
7
8
9
10
11
12
13
14
15

DEVICE FOR A PERSON TO SIT ON FOR TRAINING PURPOSES FOR EXECUTING A LEG ROTATION MOVEMENT SIMILAR TO RIDING A BICYCLE

BACKGROUND OF THE INVENTION

Field of the Invention

The invention relates to a device for a person to sit on for training purposes for executing a leg rotation movement similar to cycling with a saddle and a bottom bracket bearing.

Brief Description of the Related Art

Cycling people as a rule use bicycles which they can ride on roads and pathways. Including certainly for training purposes. With regard to bad weather days, days in winter or additional training, generic devices have been proposed which allow a cycling person to sit on. Such devices are for example known as ergometers, they are immobile and stand on the floor. As the person steps on the bottom bracket bearing, the force is transferred to a rotating disc which has a brake with adjustment options associated with it.

Apart from ergometers there exist so-called roller trainers, which are combined with a fully-fledged bicycle. The rear wheel of the bicycle is placed onto an immobile roller, and the bicycle can then be used without it moving from the spot.

There has been a development over the last few years with regard to these rollers. They have been equipped with measuring techniques and internet connections, which allows the pedal power transmitted to a roller to be captured, measured and compared via online connections to other persons using these rollers.

With these roller trainers the development has been going in a direction, where the rear wheels of bicycles are no longer placed on rollers, but where the bicycle frames, after removal of the rear wheel, are attached with their dropouts on an axis, such as a disc. This axis can support a sprocket set similar to a normal cycle with derailleur.

In this way the pedal power of the person sitting on the bicycle is initiated directly. The dropouts however are in this case, as described above, directly connected to the roller trainer.

This means that there exist forces affecting the dropouts. In particular when the pedals are operated really vigorously, it is normal for a cycle ridden on the road to be deflected sideways. Some well-known sprinters are known for their very rocky cycling style during the last 100 metres of a final sprint. With a bicycle clamped into a roller trainer it is not possible for the cycle to deflect to the right or the left. The roller trainer is routed firmly to the floor, any occurring forces are transmitted via the same into the floor and into laterally arranged profiles for example. The dropouts in this case are subject to strong forces, torsional movements occur which can result in damage to the dropouts, which is disadvantageous in particular in the case of expensive racing bikes with carbon frames.

SUMMARY OF THE INVENTION

The invention is based on the objective to propose a device for a cycling person to sit on for training purposes, with which in particular expensive bikes are treated with care without having to forego the use of a current roller trainer.

According to the invention this objective is achieved in that the device for a person to sit on for training purposes comprises at least one mounting element for immobile mounting and that it comprises connecting sections for connection to a roller trainer, which are similar to dropouts of a bicycle frame.

The proposal therefore relates to a device for a person to sit on with mounting elements on the floor, enabling the cyclist to actuate the bottom bracket bearing in an immobile manner. The device according to the invention however, is not a roller trainer, because it does not comprise a force-absorbing element such as a rotating disc. Rather, the device according to the invention has connecting sections, which are similar to the dropouts of the bicycle frame. The connecting sections can be connected to the roller trainer in place of the dropouts of a bicycle frame, so that by using the device according to the invention it is possible to use the advanced, in particular internet-connected, roller trainers.

The device according to the invention therefore forms a sit-on element, which replaces the normal bicycle. It is no longer necessary the remove the rear wheel from an expensive, in particular carbon bicycle and to connect the frame of this expensive bicycle to the roller trainer. Rather the wheel can be spared; the device according to the invention is taken and connected to the roller trainer. It is possible to use the device according to the invention in conjunction with different roller trainers.

According to a first further development of the invention it is provided that the mounting elements are mounting legs, which may comprise widenings at their free ends. The mounting legs form a frame, with which the device according to the invention is securely mounted on a floor. The widenings or other mouldings at the free ends of the mounting legs provide a secure stand, via these widenings forces can be passed into the floor without the device according to the invention tilting in any way.

The device according to the invention comprises a saddle for the person who is training, the saddle being preferably height-adjustable. Apart from the bottom bracket bearing a further development of the invention also provides for example a handhold similar to a handlebar for the person, so that he or she can support himself/herself with the upper body for example in the sitting position similar to cycling. The handhold may be shaped in the manner of a handlebar, wherein different types of handlebar are possible. The handhold is preferably arranged so as to be height-adjustable, thereby enabling different sitting positions for one or more persons to be arranged on the device. A low-level arrangement of the handhold allows for an arrangement similar to a racing driver with deeply bent back; if the handhold is set to a higher level, another person can use the device according to the invention more like a city cycle with an upright seat.

The forces introduced into the bottom bracket bearing have to be transmitted to the roller trainer, to this end the bottom bracket bearing is assigned a power-transfer means according to a further development of the invention. This power-transfer means may for example be a chain, in particular then, when the roller trainer is arranged to receive a chain due to the provision of a sprocket set. Change-over of the chain to different to different sprockets of the sprocket set can be done using a customary derailleur assigned to the device according to the invention.

The power-transfer means may also be designed as a toothed belt, in particular if the roller trainer has a respective pulley for receiving a toothed belt assigned to it and if, as required, the roller trainer or the device has a gear assigned to it.

The device according to the invention may be manufactured from a light material, for example from aluminium or a fibre-reinforced composite such as carbon.

In particular then, when the device according to the invention is manufactured from a light material, it may be provided according to a further development of the invention that the connecting elements similar to the dropouts of a bicycle frame for connecting the device according to the invention to the roller trainer are manufactured from a hard material or a hardened material.

Furthermore it may be provided that the device is equipped with a gear change. This gear change may be of electronic or mechanical design.

BRIEF DESCRIPTION OF THE DRAWINGS

An exemplary embodiment of the invention which reveals further inventive features is shown in the drawing, in which The sole FIGURE shows a lateral view of the device according to the invention for a cycling person to sit on for training purposes.

DETAILED DESCRIPTION OF THE PREFERRED EMBODIMENTS

The cycling person 1 has assumed a bent position on the inventive device 2 similar to that of a racing cyclist. The device 2 according to the invention is immobile, it is placed on a floor 5 via mounting legs 3 with widenings 4.

The device 2 according to the invention is designed in the manner of a bicycle with a frame 6, a handhold 7 similar to a handlebar, a saddle 8 and a bottom bracket bearing 9.

The device is attached to a known roller trainer 10. The roller trainer 10 provides an axis, here with a sprocket set 11, and a flywheel 12, to which the device 2 according to the invention is attached via its frame. Attaching is performed via connecting sections 13, which are constructed in the manner of dropouts of a bicycle frame.

The bottom bracket bearing 9 and the sprocket set 11 are connected to each other in a power-transferring manner via a power transfer means, here a chain 14.

The device 2 according to the invention can be attached to the roller trainer in place of a bicycle, the rear wheel of which has been removed. The roller trainer 10 has a mounting frame 15, which is mounted on the floor 5 in a tilt-proof manner. The roller trainer 10 may be equipped with measuring devices and also with transmission devices as well as a connection for networks.

The invention claimed is:

1. A device configured for a person to sit on for training purposes for executing a leg rotation movement similar to cycling, the device comprising:

a saddle on a frame;

a bottom bracket bearing;

at least one mounting element for immobile mounting, wherein the at least one mounting element is fixed with the frame, wherein the at least one mounting element comprises two mounting legs engageable with a floor, a widening extending between the two mounting legs, and two vertical legs, each of the mounting legs is connected to one of the vertical legs, and the two vertical legs and the widening form a triangle configuration; and connecting sections similar to dropouts of a bicycle frame for connection of the device to a roller trainer;

wherein the at least one mounting element is separate from the roller trainer.

2. The device according to claim 1, wherein the at least one mounting element comprises mounting legs.

3. The device according to claim 1, further comprising a handhold configured for supporting the upper body of the person.

4. The device according to claim 1, further comprising a power transfer means connecting the bottom bracket bearing to the roller trainer.

5. The device according to claim 4, wherein the power transfer means is a chain or a belt.

6. The device according to claim 1, wherein the device is manufactured from a fibre-reinforced composite.

7. The device according to claim 6, wherein the connecting sections are manufactured from a hardened material.

8. The device according to claim 1, wherein the device is equipped with an electronic or mechanical gear change.

* * * * *